US008934824B2

(12) United States Patent
Suzuki

(10) Patent No.: US 8,934,824 B2
(45) Date of Patent: Jan. 13, 2015

(54) NIP MEMBER CONFIGURATION OF A FIXING DEVICE

(71) Applicant: Kaoru Suzuki, Ichinomiya (JP)

(72) Inventor: Kaoru Suzuki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 166 days.

(21) Appl. No.: 13/623,368

(22) Filed: Sep. 20, 2012

(65) Prior Publication Data

US 2013/0071158 A1 Mar. 21, 2013

(30) Foreign Application Priority Data

Sep. 20, 2011 (JP) ..... 2011-205142

(51) Int. Cl.
*G03G 15/20* (2006.01)

(52) U.S. Cl.
CPC .... *G03G 15/2053* (2013.01); *G03G 2215/2035* (2013.01)
USPC ..... 399/329

(58) Field of Classification Search
USPC ..... 399/328, 329; 219/216
See application file for complete search history.

(56) References Cited

U.S. PATENT DOCUMENTS

| | | | | |
|---|---|---|---|---|
| 7,792,476 | B2 * | 9/2010 | Seol et al. | 399/329 |
| 7,881,650 | B2 * | 2/2011 | Shin et al. | 399/329 |
| 8,559,862 | B2 * | 10/2013 | Kondo et al. | 399/329 |
| 2009/0208264 | A1 | 8/2009 | Fujiwara et al. | |

FOREIGN PATENT DOCUMENTS

JP 2008233886 A 10/2008

* cited by examiner

*Primary Examiner* — William J Royer
(74) *Attorney, Agent, or Firm* — Banner & Witcoff, Ltd.

(57) ABSTRACT

A fixing device which may include a flexible cylindrical member which has an inner peripheral surface and is configured to rotate about an axis, a heater arranged inside the cylindrical member and extends in an axial direction of the cylindrical member, and a nip member. The nip member may include a contact surface configured to contact the cylindrical member, and has a predetermined length in a sheet conveying direction. Further, the nip member may have an axial length which includes a predetermined range, wherein the predetermined range along the axial length represents a maximum width of a recording sheet upon which a developer image is fixed. The fixing device may also include a guide member. The guide member and the nip member may be at least partially separated along the predetermined range of the nip member within the predetermined length of the contact surface in the sheet conveying direction.

18 Claims, 13 Drawing Sheets

NIP MEMBER CONFIGURATION OF A FIXING DEVICE

CROSS-REFERENCE TO RELATED APPLICATION

This application claims priority to JP 2011-205142, filed Sep. 20, 2011, whose contents are expressly incorporated herein by reference.

TECHNICAL FIELD

Aspects of the disclosure relate to a fixing device that fixes a toner image onto a recording sheet.

BACKGROUND

A fixing device is known that includes a cylindrical heat film, a metal plate that slides on an inner peripheral surface of the heat film, a pressure roller that forms a nip portion by pinching the heat film between the pressure roller and the metal plate, a halogen heater arranged inside the heat film, and a cylindrical film guide that guides the inner peripheral surface of the heat film. With this technique, an opening is formed at a lower portion of the film guide. Both end portions of the metal plate, in a sheet conveying direction, are entirely held by the film guide to face the opening.

However, with this technique, since both the end portions of the metal plate, in the sheet conveying direction, are entirely supported by the film guide, heat of the metal plate (particularly in an image formation range) is radiated to the outside through the film guide and the heat film that slides on the film guide. The nip portion may not be efficiently heated.

SUMMARY

Aspects of the disclosure relate to a fixing device configured to fix a developer image onto a recording sheet. The fixing device may include a flexible cylindrical member which has an inner peripheral surface and is configured to rotate about an axis, a heater arranged inside the cylindrical member and extends in an axial direction of the cylindrical member; and a nip member. The nip member may include a contact surface which is configured to contact the cylindrical member, and has a predetermined length in the sheet conveying direction. Further, the nip member may have an axial length which includes a predetermined range, wherein the predetermined range along the axial length represents a maximum width of a recording sheet upon which the developer image is fixed. The fixing device may also include a pressure member, wherein the pressure member and the nip member may be configured to pinch the cylindrical member therebetween. The fixing device may also include a guide member arranged at least at one side of the nip member in the sheet conveying direction and includes a guide surface that is configured to guide the inner peripheral surface of the cylindrical member. Further, the inner peripheral surface of the cylindrical member may be configured to slide on the nip member. Also, the guide member and the nip member may be at least partially separated along the predetermined range of the nip member within the predetermined length of the contact surface in the sheet conveying direction.

A fixing device for fixing a developer image onto a recording sheet. The fixing device may include a belt having a first surface and a second surface that is an opposite surface of the first surface, wherein the belt is configured to slide on a nip member. The fixing device may also include a heater which is arranged inside the belt and has a longitudinal length. The nip member may include a contact surface which is configured to contact the belt, and has a predetermined length in a sheet conveying direction. The nip member may have a longitudinal length which extends in a direction parallel to the longitudinal length of the heater and includes a predetermined range, wherein the predetermined range along an axial length represents a maximum width of the recording sheet upon which the developer image is fixed. The fixing device may also include a guide member that has a guide surface arranged at least at one side of the nip member in the sheet conveying direction that is configured to guide the first surface of the belt. Further, the guide member may not be in contact within an nip member within the image formation range of the nip member.

DETAILED DESCRIPTION

An embodiment of the present invention is described below in detail with reference to the figures. The general configuration of a laser printer 1 (an image forming apparatus) including a fixing device 100 according to an embodiment of the invention is briefly described and then the detailed configuration of the fixing device 100 is described.

The following description applies directions with reference to a user of the laser printer 1. In particular, it is assumed that the right side in FIG. 1 is "front," the left side is "rear," the near side is "left," and the deep side is "right." Also, it is assumed that the up-down direction in FIG. 1 is "up and down."

Figure 1:
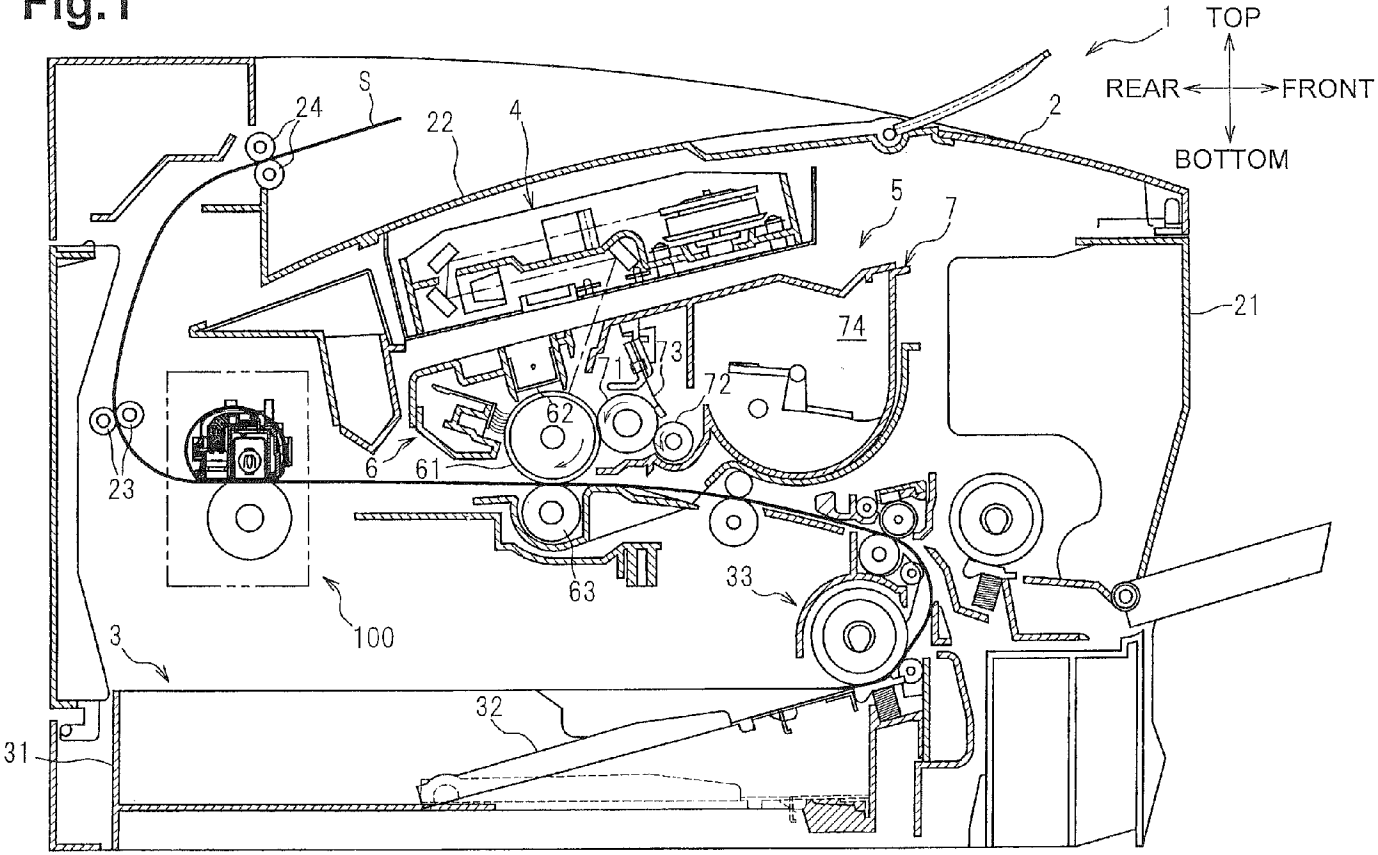
FIG. 1 illustrates a general configuration of a laser printer including a fixing device according to an embodiment of the invention.

As shown in FIG. 1, the laser printer 1 includes a feed unit 3 for feeding a sheet S as an example of a recording sheet, an exposure device 4, a process cartridge 5 for transferring a toner image (a developer image) on the sheet S, and the fixing device 100 for fixing the toner image transferred on the sheet S. The feed unit 3, the exposure device 4, the process cartridge 5, and the fixing device 100 are arranged in a body housing 2.

The feed unit 3 is provided in a lower section of the body housing 2. The feed unit 3 includes a feed tray 31, a sheet push plate 32, and a feed mechanism 33. The sheet S housed in the feed tray 31 is lifted upward by the sheet push plate 32, and is fed by the feed mechanism 33 toward the process cartridge 5 (an area between a photosensitive drum 61 and a transfer roller 63).

The exposure device 4 is arranged in an upper section of the body housing 2. The exposure device 4 includes a laser light-emitting portion (not shown), a polygonal mirror (shown without a reference sign), a lens (shown without a reference sign), and a reflection mirror (shown without a reference sign). The exposure device 4 exposes the surface of the photosensitive drum 61 to light by scanning the surface of the photosensitive drum 61 at a high speed with laser light (see a dotted-chain line) emitted from the laser light-emitting portion based on image data.

The process cartridge 5 is arranged below the exposure device 4. The process cartridge 5 is removably mounted on the body housing 2 through an opening that appears when a front cover 21 provided at the body housing 2 is open. The process cartridge 5 includes a drum unit 6 and a developing unit 7.

The drum unit 6 includes the photosensitive drum 61, a charging unit 62, and the transfer roller 63. The developing unit 7 is removably mounted on the drum unit 6. The developing unit 7 includes a developing roller 71, a feed roller 72, a layer-thickness regulation blade 73, and a toner container 74 that houses a toner (a developer).

In the process cartridge 5, the charging unit 62 charges the surface of the photosensitive drum 61 uniformly with electricity and then the exposure device 4 exposes the surface of the photosensitive drum 61 to the laser light by high-speed scanning Hence, an electrostatic latent image based on image data is formed on the photosensitive drum 61. The toner in the toner container 74 is fed to the developing roller 71 through the feed roller 72, enters an area between the developing roller 71 and the layer-thickness regulation blade 73, and is held on the developing roller 71 as a thin layer with a constant thickness.

The toner held on the developing roller 71 is fed from the developing roller 71 to the electrostatic latent image formed on the photosensitive drum 61. Hence, the electrostatic latent image becomes a visible image, and a toner image is formed on the photosensitive drum 61. Then, when a sheet S is conveyed between the photosensitive drum 61 and the transfer roller 63, the toner image on the photosensitive drum 61 is transferred on the sheet S.

The fixing device 100 is provided at the rear of the process cartridge 5. The toner image transferred on the sheet S is thermally fixed to the sheet S when the sheet S passes through the fixing device 100. Then, the sheet S is output on an output tray 22 by convey rollers 23 and 24.

Figure 2:
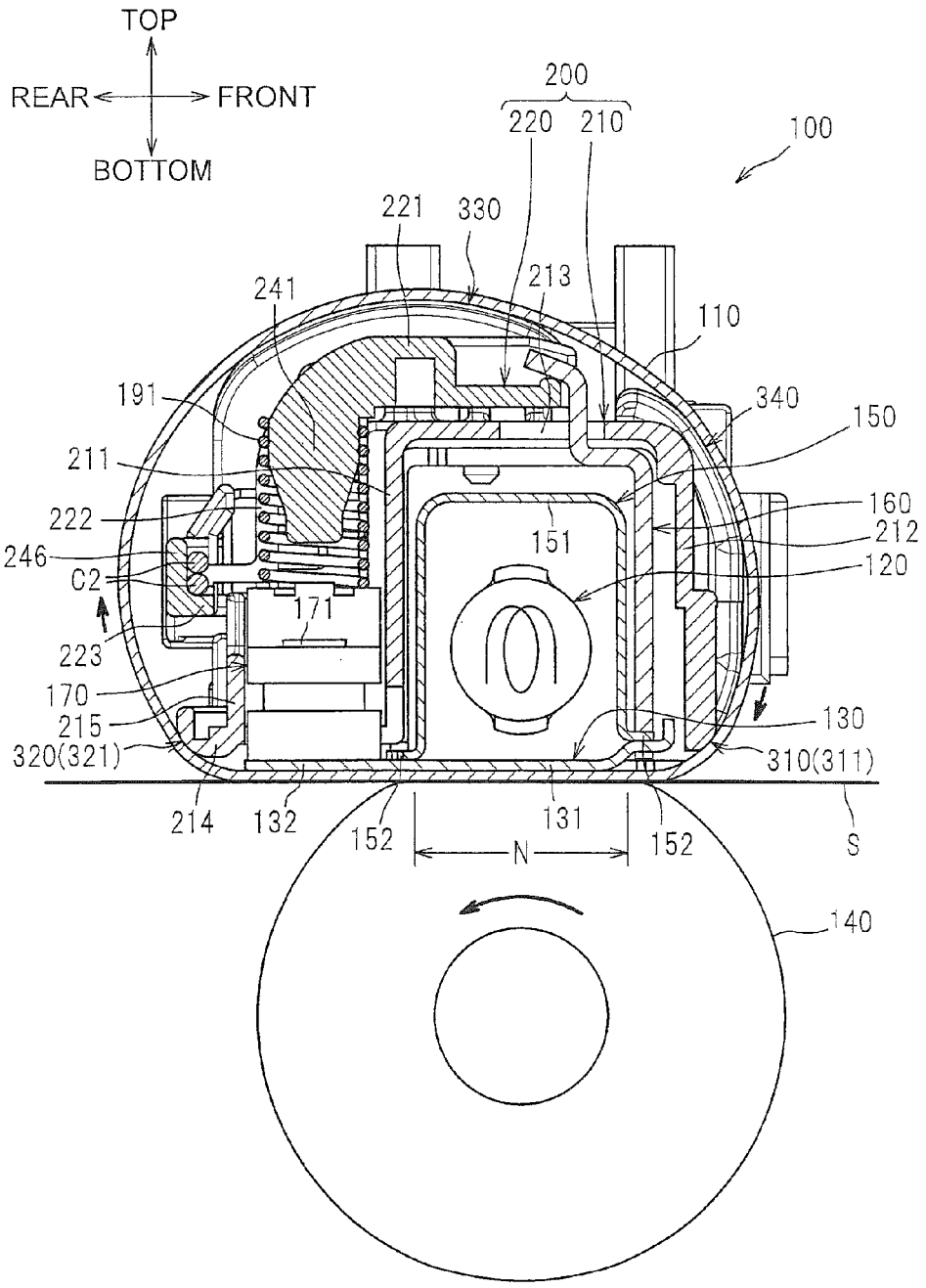
FIG. 2 is a cross-sectional view of the fixing device in an area near a thermostat.

Referring to FIG. 2, the fixing device 100 may include a fusing belt 110 as an example of a cylindrical member, a halogen lamp 120 as an example of a heater, a nip plate 130 as an example of a nip member, a pressure roller 140 as an example of a pressure member, a reflection member 150, a stay 160, a thermostat 170 and two thermistors 180 (see FIGS. 3 and 4), cables C1 and C2 (see FIG. 5), and a cover member 200.

The fusing belt 110 is an endless (cylindrical) belt that is heat resistant and flexible. The rotation of the fusing belt 110 is guided by a guide portion (a nip upstream guide 310, a nip downstream guide 320, an upper guide 330, and a front guide 340, which will be described later) that is formed at the cover member 200. In this embodiment, the fusing belt 110 is made of metal. For example, the fusing belt 110 may be made of stainless steel or nickel.

The halogen lamp 120 is a member for applying heat to the toner on the sheet S by generating radiant heat and applying the heat to the nip plate 130 and the fusing belt 110 (a nip portion N). The halogen lamp 120 is arranged inside the fusing belt 110 at predetermined distances from inner surfaces of the fusing belt 110 and the nip plate 130.

Figure 3:
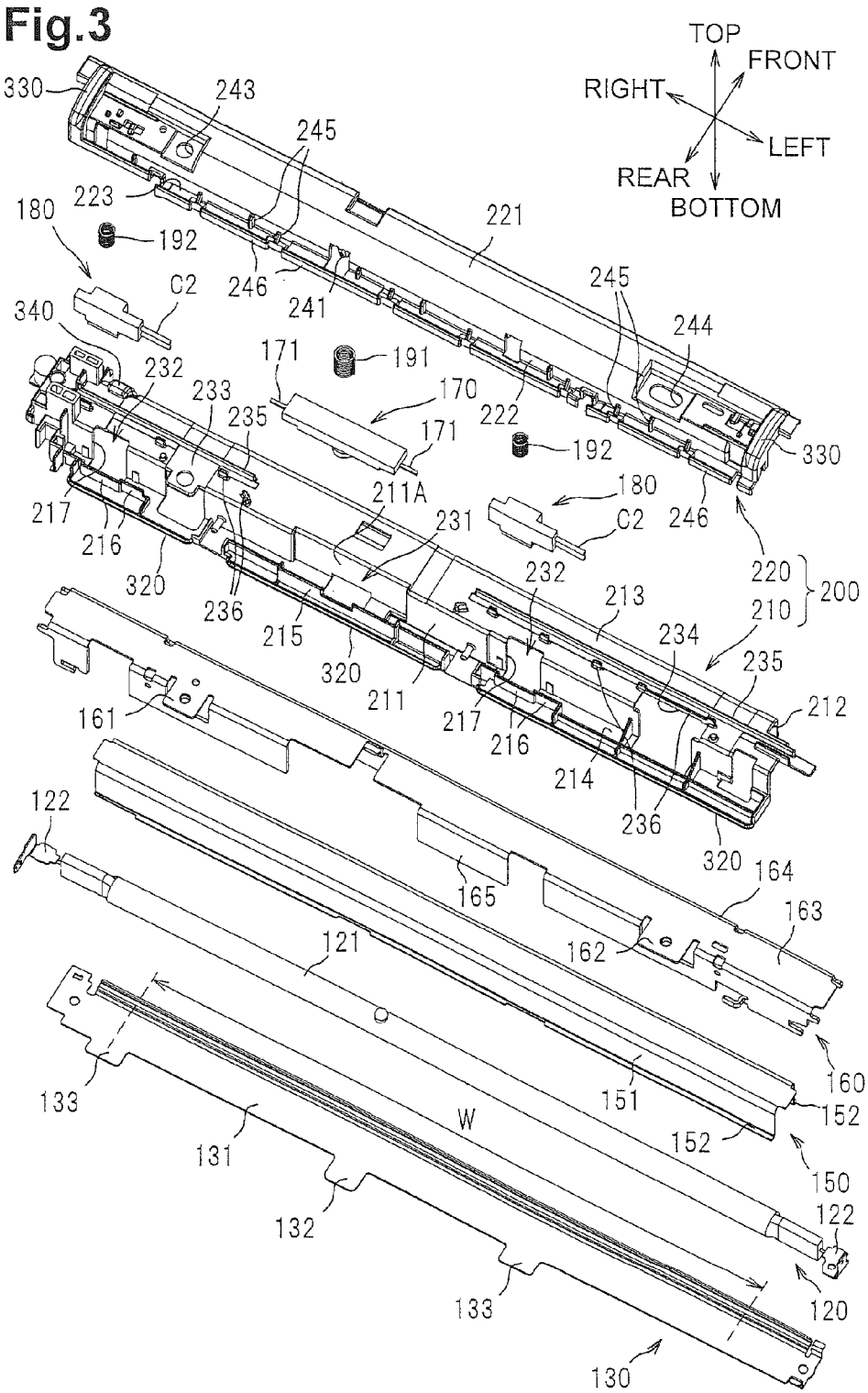
FIG. 3 is a perspective view showing a nip plate, a halogen lamp, a reflection member, a stay, a first cover member, a thermostat, thermistors, and a second cover member.

Referring to FIG. 3, the halogen lamp 120 includes a filament (not shown) in a long cylindrical glass tube 121. Both ends in the longitudinal direction of the glass tube 121 are closed and inert-gas containing a halogen element is sealed in the glass tube 121. A pair of electrodes 122 are provided at both ends in the longitudinal direction of the halogen lamp 120. The pair of electrodes 122 are electrically connected with ends of the filament in the glass tube 121.

Referring back to FIG. 2, the nip plate 130 is a plate-like member that receives the radiant heat from the halogen lamp 120. The nip plate 130 may include a contact surface which is configured to contact the fusing belt 110 and includes a predetermined length in the sheet conveying direction. The nip plate 130 may include an axial length which includes a predetermined range, wherein the predetermined range along the axial length represents a maximum width of a recording sheet upon which the developer is fixed. The lower surface of the nip plate 130 slides on the inner peripheral surface of the fusing belt 110. In this embodiment, the nip plate 130 is made of metal, and is formed by bending a metal plate, for example, an aluminum plate having a higher thermal conductivity than the thermal conductivity of the stay 160 made of steel (described later).

Referring to FIG. 3, the nip plate 130 may include a base portion 131, a first extension portion 132, and second extension portions 133.

The inner peripheral surface of the fusing belt 110 may slide on the base portion 131. The base portion 131 transfers the heat from the halogen lamp 120 to the toner on the sheet S through the fusing belt 110.

The first extension portion 132 and the second extension portions 133 are flat plates, and protrude rearward from the rear end of the base portion 131. In other words, the first extension portion 132 and the second extension portions 133 extend to the downstream side with respect to the nip portion N in a conveying direction of the sheet S.

In particular, a single first extension portion 132 is formed at a position near the center in the left-right direction of the rear end of the base portion 131. The thermostat 170 may be positioned on the upper surface of the first extension portion 132 to face the first extension portion 132. Also, two second extension portions 133 are respectively formed at positions near the center and right end in the left-right direction of the rear end of the base portion 131. The two thermistors 180 may be positioned on the upper surfaces of the second extension portions 133 to face the second extension portions 133.

Referring to FIG. 2, the pressure roller 140 is a member for forming the nip portion N between the pressure roller 140 and the fusing belt 110 by pinching the fusing belt 110 between the pressure roller 140 and the nip plate 130. The pressure roller 140 is arranged below the nip plate 130. In this embodiment, one of the nip plate 130 and the pressure roller 140 is urged to the other to form the nip portion N.

The pressure roller 140 is rotationally driven when a drive force is transmitted thereto from a motor (not shown) provided in the body housing 2. The fusing belt 110 is rotated by the rotation of the pressure roller 140 because of a friction force of the pressure roller 140 against the fusing belt 110 (or the sheet S). The sheet S with the toner image transferred thereon is conveyed through an area between the pressure roller 140 and the heated fusing belt 110 (the nip portion N). Accordingly, the toner image is thermally fixed.

The reflection member 150 is a member for reflecting the radiant heat from the halogen lamp 120 toward the nip plate 130. The reflection member 150 is arranged at a predetermined distance from the halogen lamp 120 so as to cover or surround the halogen lamp 120 inside the fusing belt 110. More specifically, the reflection member 150 is arranged between the halogen lamp 120 and the stay 160. Since the reflection member 150 is provided, the nip plate 130 can be efficiently heated.

The reflection member 150 may be formed by bending a material with a high reflectivity for infrared radiation or far-infrared radiation, for example, an aluminum plate, into a substantially U-like shape in cross-sectional view. To be more specific, the reflection member 150 may include a reflection portion 151 having a curved shape, and flange portions 152 extending outward in the front-rear direction from both end portions in the front-rear direction of the reflection portion 151.

The stay 160 supports front and rear end portions of the nip plate 130 (the base portion 131) through the reflection member 150 (the flange portions 152), and hence receives a load from the pressure roller 140. The stay 160 is arranged inside the fusing belt 110 so as to cover the halogen lamp 120 and the reflection member 150. It is noted that, if the nip plate 130 urges the pressure roller 140, the load is a reactive force of the urging force applied by the nip plate 130 to the pressure roller 140.

The stay 160 may be formed by bending a material with a relatively high rigidity, for example, a steel sheet into a substantially U-like shape in cross-sectional view along the outer surface shape of the reflection member 150 (the reflection portion 151). Contact portions of the stay 160 and reflection member 150 with respect to the nip plate 130 have a structure partially having gaps, so that the contact area with respect to the nip plate 130 is decreased. Hence, the rigidity and heating efficiency can be increased.

Referring to FIG. 3, the stay 160 may include an upper wall 163, a front wall 164 extending downward from the front end of the upper wall 163, and a rear wall 165 extending downward from the rear end of the upper wall 163, and may be formed to have a substantially U-like shape in cross-sectional view. Also, a right fixing portion 161 is provided at a right portion of the upper wall 163, and a left fixing portion 162 is provided at a left portion of the upper wall 163. The right fixing portion 161 and the left fixing portion 162 extend rearward from the upper wall 163, and respectively have screw holes (illustrated without a reference sign) that respectively penetrate through the right fixing portion 161 and the left fixing portion 162.

Referring to FIG. 2, the thermostat 170 is a member having a bimetal (not shown) and configured to stop application of electricity when a predetermined temperature is detected. The thermostat 170 is arranged inside the fusing belt 110, at a side opposite to the halogen lamp 120 with respect to the reflection member 150 and the stay 160 (outside the stay 160).

To be more specific, the lower surface of the thermostat 170 serves as a temperature detection surface that is arranged to face the upper surface of the first extension portion 132 (a surface at a side opposite to a side of first extension portion 132 that faces the pressure roller 140). The first extension portion 132 is a portion directly extending from the base portion 131 that pinches the fusing belt 110 (and the sheet S) between the base portion 131 and the pressure roller 140. Since the thermostat 170 is arranged to face the first extension portion 132, the temperature in an area near the nip portion N can be accurately detected.

Also, the thermostat 170 includes plate-like electrodes 171 at both left and right end surfaces of the thermostat 170. The electrodes 171 protrude to the outside in the left-right direction (see also FIG. 3).

Figure 4:
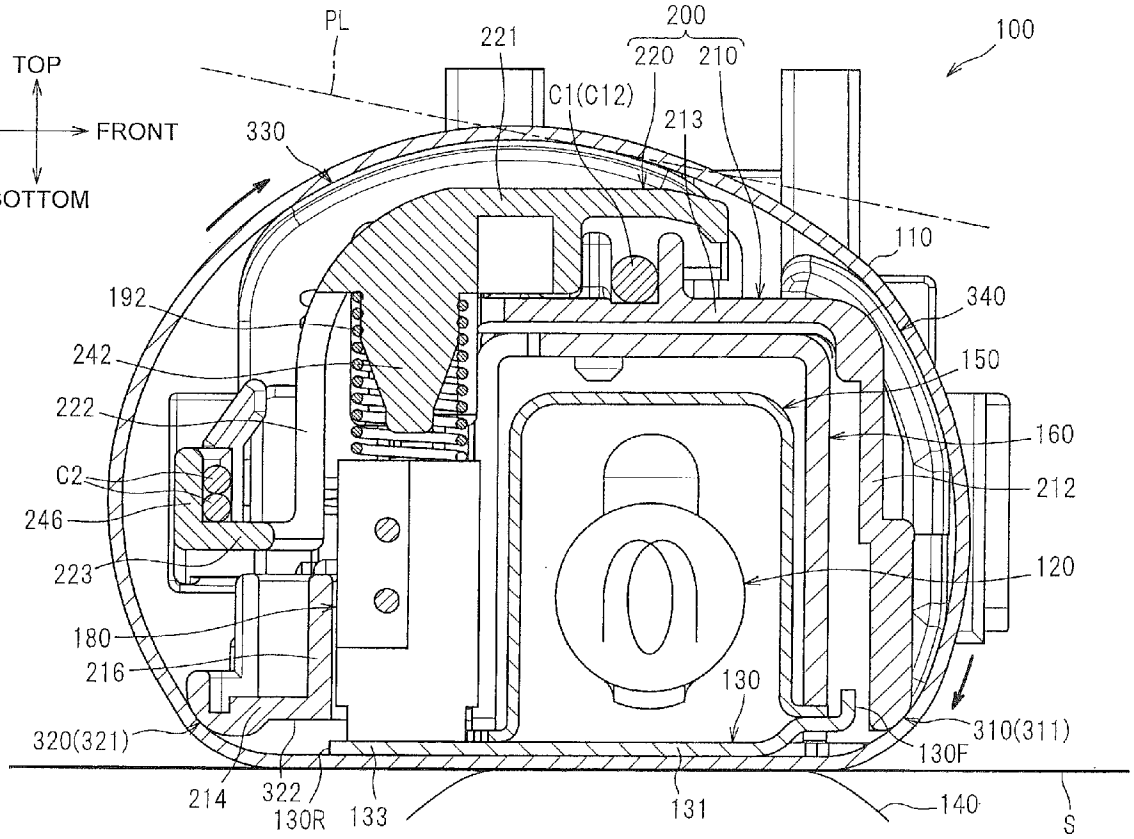
FIG. 4 is an enlarged cross-sectional view showing an area near the thermistor arranged at the center in the left-right direction of the fixing device.

Referring to FIG. 4, the thermistors 180 are temperature sensors that detect the temperature of the nip plate 130. The thermistors 180 are arranged inside the fusing belt 110, at a side opposite to the halogen lamp 120 with respect to the reflection member 150 and the stay 160.

To be more specific, the lower surfaces of the thermistors 180 serve as temperature detection surfaces that are arranged to face the upper surfaces of the second extension portions 133. The second extension portions 133 directly extend from the base portion 131. Since the thermistors 180 are arranged to face the second extension portions 133, the temperature in an area near the nip portion N can be accurately detected.

Referring to FIGS. 2 and 4, the thermostat 170 is urged by a coil spring 191 to the first extension portion 132 of the nip plate 130, and the thermistors 180 are urged by coil springs 192 to the second extension portions 133 of the nip plate 130. Accordingly, the positional relationship between the nip plate 130, which is a subject to be detected, and the thermostat 170, and the positional relationship between the thermistors 180 become stable. Hence, the temperature can be further accurately detected.

Figure 5:
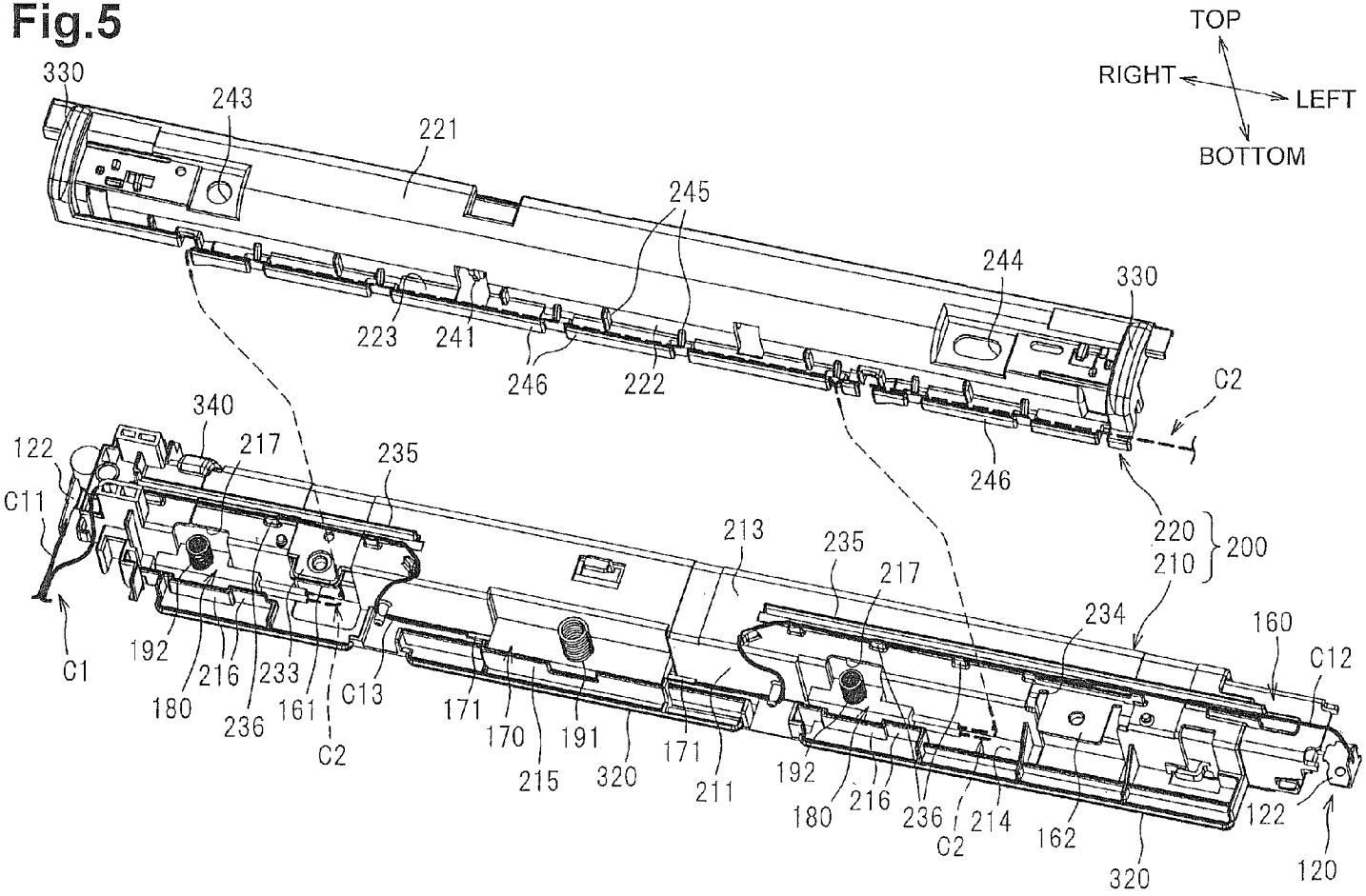
FIG. 5 is a perspective view showing arrangement of cables.

The cable C1 indicated by a thick solid line in FIG. 5 is a conductor that supplies electric power to the halogen lamp 120. The cable C1 is arranged inside the fusing belt 110, at a side opposite to the halogen lamp 120 with respect to the stay 160 (see FIG. 4). The cable C1 is connected with the halogen lamp 120 and the thermostat 170.

To be more specific, the cable C1 includes a conductor C11 that is connected with the right electrode 122 of the halogen lamp 120, and conductors C12 and C13 that are directly or indirectly connected with left electrode 122 of the halogen lamp 120.

The conductor C12 extends from the left electrode 122 of the halogen lamp 120, passes above an upper wall 213 of a first cover member 210 (described later), extends rightward, extends downward along a rear wall 211 at a position near the center in the left-right direction of the first cover member 210, and then is connected with the left electrode 171 of the thermostat 170. Also, the conductor C13 connected with the right electrode 171 of the thermostat 170 extends upward along the rear wall 211, passes above the upper wall 213 of the first cover member 210, extends rightward, and then is drawn from a right end portion of the fusing belt 110 together with the conductor C11.

An end portion of the cable C1 drawn from the right end portion of the fusing belt 110 is connected with a power board (not shown) provided in the body housing 2. Hence, electric power can be supplied to the halogen lamp 120. Since the thermostat 170 is connected in the middle of the cable C1, if the nip plate 130 is excessively heated, the thermostat 170 cuts the application of electricity. The application of electricity to the halogen lamp 120 can be immediately cut.

The cable C2 indicated by a thick broken line in FIG. 5 is a conductor that is connected with the thermistors 180. Similarly to the cable C1, the cable C2 is arranged inside the fusing belt 110, at a side opposite to the halogen lamp 120 with respect to the stay 160 (see FIG. 4).

To be more specific, the cable C2 is connected with thermistor elements (not shown) arranged in housings of the thermistors 180, and is drawn from left end surfaces of the housings of the thermistors 180. The cable C2 extending from the thermistors 180 extend upward, extend leftward along a rear wall 222 of a second cover member 220 (described later), and is drawn from a left end portion of the fusing belt 110.

An end portion of the cable C2 drawn from the left end portion of the fusing belt 110 is connected with a control board (not shown) provided in the body housing 2. The detection result of the thermistors 180 is output to the control board and used for control of the halogen lamp 120.

The cover member 200 supports the thermostat 170, the thermistors 180, and the cables C1 and C2. The cover member 200 is arranged inside the fusing belt 110 to cover the stay 160. The cover member 200 may include the first cover member 210 and the second cover member 220.

The first cover member 210 may have a substantially U-like shape in cross-sectional view and extend in the right-left direction. The first cover member 210 covers the stay 160 at a side opposite to the halogen lamp 120 with respect to the stay 160 (see also FIGS. 2 and 4). The first cover member 210 extends from one end to the other end in the axial direction of the fusing belt 110, or more particularly from the right end to the left end of the fusing belt 110, and supports the thermostat 170, the thermistors 180, and the cable C1.

In this embodiment, the first cover member 210 is formed of resin, such as liquid crystal polymer, polyetheretherketone (PEEK) resin, or polyphenylene sulfide (PPS) resin. The rear wall 211 of the first cover member 210 is positioned between the electrodes 171 of the thermostat 170 and the reflection member 150 having conductivity, and between the electrodes 171 of the thermostat 170 and the stay 160 having conductivity. The rear wall 211 ensures insulation between the electrodes 171, and the reflection member 150, and between the electrodes 171 and the stay 160.

Referring to FIG. 3, the first cover member 210 include the rear wall 211, a front wall 212, the upper wall 213 extending so as to connect the upper ends of the rear wall 211 and front wall 212 with each other, and an extension wall 214 extending rearward from the lower end of the rear wall 211. Also, the first cover member 210 may include a first positioning portion 231, two second positioning portions 232, a fixing portion 233, a notch 234, and ribs 235 and 236.

The first positioning portion 231 positions the thermostat 170. The first positioning portion 231 is defined by a recess 211A provided at a position near the center in the right-left direction of the rear wall 211, and a vertical wall 215 having a substantially U-like shape in plain view, vertically arranged on the extension wall 214, and provided to face the recess 211A. The thermostat 170 is arranged at the first positioning portion 231, and hence is positioned in the front-rear direction and the right-left direction (see FIG. 5).

The second positioning portions 232 position the thermistors 180. The second positioning portions 232 are defined by vertical walls 216 provided at a position near the center and a position near the right end in the right-left direction of the extension wall 214, and the rear wall 211 facing the vertical walls 216. The rear wall 211 defining the second positioning portions 232 have openings 217. Portions of the thermistors 180 protruding forward are fitted to the openings 217. The thermistors 180 are arranged at the second positioning portions 232, and hence are positioned in the front-rear direction and the left-right direction (see FIG. 5).

The openings 217 extend from the rear wall 211 to the extension wall 214, so that the thermistors 180 are exposed to the nip plate 130 through the openings 217. Also, a bottom wall of the first positioning portion 231 (the extension wall 214) has a hole (shown without a reference sign), so that the thermostat 170 is exposed to the nip plate 130.

The fixing portion 233 fixes the first cover member 210 to the right fixing portion 161 of the stay 160. The fixing portion 233 is provided at a right portion of the first cover member 210 to correspond to the right fixing portion 161. The fixing portion 233 has a through hole (shown without a reference sign) having a substantially circular shape in plain view to correspond to the screw hole of the right fixing portion 161.

The notch 234 is provided in a left portion of the first cover member 210 and extends from the upper wall 213 to the rear wall 211, and then to the extension wall 214. Referring to FIG. 5, when the first cover member 210 is assembled with the stay 160, the left fixing portion 162 of the stay 160 is exposed through the notch 234. The notch 234 has a larger width in the right-left direction than the length in the right-left direction of the exposed left fixing portion 162.

The ribs 235 and 236 protrude from the upper wall 213, and discontinuously extend along the right-left direction, or more specifically along the path of the cable C1 passing above the upper wall 213. The ribs 235 and 236 are provided side by side to face each other in the front-rear direction. The cable C1 is arranged between the ribs 235 and 236. Accordingly, the cable C1 can be prevented from being shifted in the front-rear direction on the upper wall 213.

Referring to FIG. 2, in this embodiment, the extension wall 214 and the vertical wall 215 of the first cover member 210 serve as an "intermediate portion" positioned at the rear side opposite to the front side, where the halogen lamp 120 is arranged, with respect to the thermostat 170, and positioned between part of the thermostat 170 and the fusing belt 110. The extension wall 214 and the vertical wall 215 serving as the intermediate portion prevent the fusing belt 110 and the thermostat 170 from coming into contact with each other.

Referring to FIG. 4, the extension wall 214 and the vertical wall 216 of the first cover member 210 serve as an "intermediate portion" positioned at the rear side opposite to the front side, where the halogen lamp 120 is arranged, with respect to the thermistors 180, and positioned between part of the thermistors 180 and the fusing belt 110. The extension wall 214 and the vertical wall 216 serving as the intermediate portion prevent the fusing belt 110 and the thermistors 180 from coming into contact with each other.

Referring to FIG. 2, the second cover member 220 may have a substantially L-like shape in cross-sectional view and extends in the right-left direction. The second cover member 220 is arranged at a side opposite to the stay 160 with respect to part of the rear wall 211 and part of the upper wall 213 of the first cover member 210. In other words, the second cover member 220 covers part of the first cover member 210 from a side opposite to the stay 160. The second cover member 220 supports the cable C2.

In this embodiment, the second cover member 220 is formed of resin, such as liquid crystal polymer, polyetheretherketone (PEEK) resin, or polyphenylene sulfide (PPS) resin.

The second cover member 220 and the first cover member 210 are assembled with each other such that the second cover member 220 is partly overlaid on the first cover member 210.

When the second cover member 220 is assembled with the first cover member 210 such that the second cover member 220 is overlaid on the first cover member 210, the cable C1 is arranged between the first cover member 210 and the second cover member 220 in a portion where an upper wall 221 of the second cover member 220 is overlaid on the upper wall 213 of the first cover member 210 in the up-down direction as shown in FIG. 4.

The thermostat 170 and the thermistors 180 are similarly arranged between the first cover member 210 and the second cover member 220 in a portion where the upper wall 221 of the second cover member 220 is overlaid on the extension wall 214 of the first cover member 210 in the up-down direction as shown in FIGS. 2 and 4.

The second cover member 220 may include the upper wall 221, the rear wall 222 extending downward from the rear end of the upper wall 221, and an extension wall 223 extending rearward from the lower end of the rear wall 222. Also, referring to FIG. 3, the second cover member 220 may include a first support portion 241, two second support portions 242 (see FIG. 4, only one of the two second support portions 242 is shown), a circular hole 243, a long hole 244, and ribs 245 and 246.

Referring to FIG. 2, the first support portion 241 supports the coil spring 191. The first support portion 241 protrudes downward from a position near the center in the left-right direction of the upper wall 221 (i.e., a portion corresponding to the first positioning portion 231 of the first cover member 210). The coil spring 191 engages with the first support portion 241 and hence is supported at the cover member 200.

Referring to FIG. 4, the second support portions 242 support the coil springs 192. The second support portions 242 protrude downward respectively from a position near the center and a position near the right end in the left-right direction of the upper wall 221 (i.e., portions corresponding to the second positioning portions 232 of the first cover member 210). The coil springs 192 engage with the second support portions 242 and hence are supported at the cover member 200.

Referring to FIG. 3, the circular hole 243 is a through hole provided in the right portion of the upper wall 221 to correspond to the screw hole of the right fixing portion 161 of the stay 160, and having a substantially circular shape in plain view. The long hole 244 is a through hole provided in the left portion of the upper wall 221 to correspond to the screw hole of the left fixing portion 162 of the stay 160, and having a long circular shape in plain view extending in the left-right direction.

The ribs 245 and 246 protrude from the extension wall 223. The ribs 245 and 246 are discontinuously provided along the path of the cable C2. More specifically, the ribs 245 are provided at a corner between the extension wall 223 and the rear wall 222 to connect the extension wall 223 with the rear wall 222. The ribs 246 vertically extend from the rear end of the extension wall 223. The ribs 245 and 246 face each other in the front-rear direction. Referring to FIG. 5, the cable C2 extending from the thermistors 180 are arranged between the ribs 245 and 246 on the extension wall 223. With this configuration, the cable C2 can be prevented from being dropped from the extension wall 223.

Referring to FIG. 4, in this embodiment, the upper wall 221 of the second cover member 220 serves as an "intermediate portion" positioned at the upper side opposite to the lower side, where the halogen lamp 120 is arranged, with respect to the cable C1, and positioned between the cable C1 and the fusing belt 110. To be more specific, the upper wall 221 is provided between the cable C1 and the fusing belt 110 to entirely cover part of the cable C1 arranged on the upper wall 213. With the upper wall 221 serving as the intermediate portion, the fusing belt 110 and the cable C1 can be prevented from coming into contact with each other.

Also, the ribs 246 of the second cover member 220 serve as an "intermediate portion" positioned at the rear side opposite to the front side, where the halogen lamp 120 is arranged, with respect to the cable C2, and positioned between the cable C2 and the fusing belt 110. With the ribs 246 serving as the intermediate portion, the fusing belt 110 and the cable C2 can be prevented from coming into contact with each other.

The intermediate portion provided at the first cover member 210 (the extension wall 214 and the vertical walls 215 and 216) and the intermediate portion provided at the second cover member 220 (the upper wall 221 and the ribs 246) are formed of resin (an insulating material). Hence, as long as the intermediate portions prevent the fusing belt 110 from coming into contact with an electrical part such as the cable C1, the intermediate portions can ensure insulation between the fusing belt 110 and the electrical part.

Referring to FIG. 4, the cover member 200 may include the guide portion upon which the inner peripheral surface of the rotational fusing belt 110 slides and, hence, guides the inner peripheral surface of the fusing belt 110. More specifically, the guide portion of the cover member 200 may include the nip upstream guide 310, the nip downstream guide 320, the upper guide 330, and the front guide 340, as examples of a guide member.

The nip upstream guide 310 guides the fusing belt 110 to a position between the nip plate 130 and the pressure roller 140. The nip upstream guide 310 is formed at a lower end portion of the front wall 212 of the first cover member 210. To be more specific, the nip upstream guide 310 may be arranged immediately upstream of an upstream end portion 130F of the nip plate 130 (at one side in the conveying direction of the sheet S) in the rotation direction of the fusing belt 110 (in a clockwise direction in FIG. 4). The nip upstream guide 310 may have a curved surface protruding toward the inner peripheral surface of the fusing belt 110. In other words, the nip upstream guide 310 may have a guide surface 311 that is a curved surface and guides the inner peripheral surface of the fusing belt 110.

Figure 6:
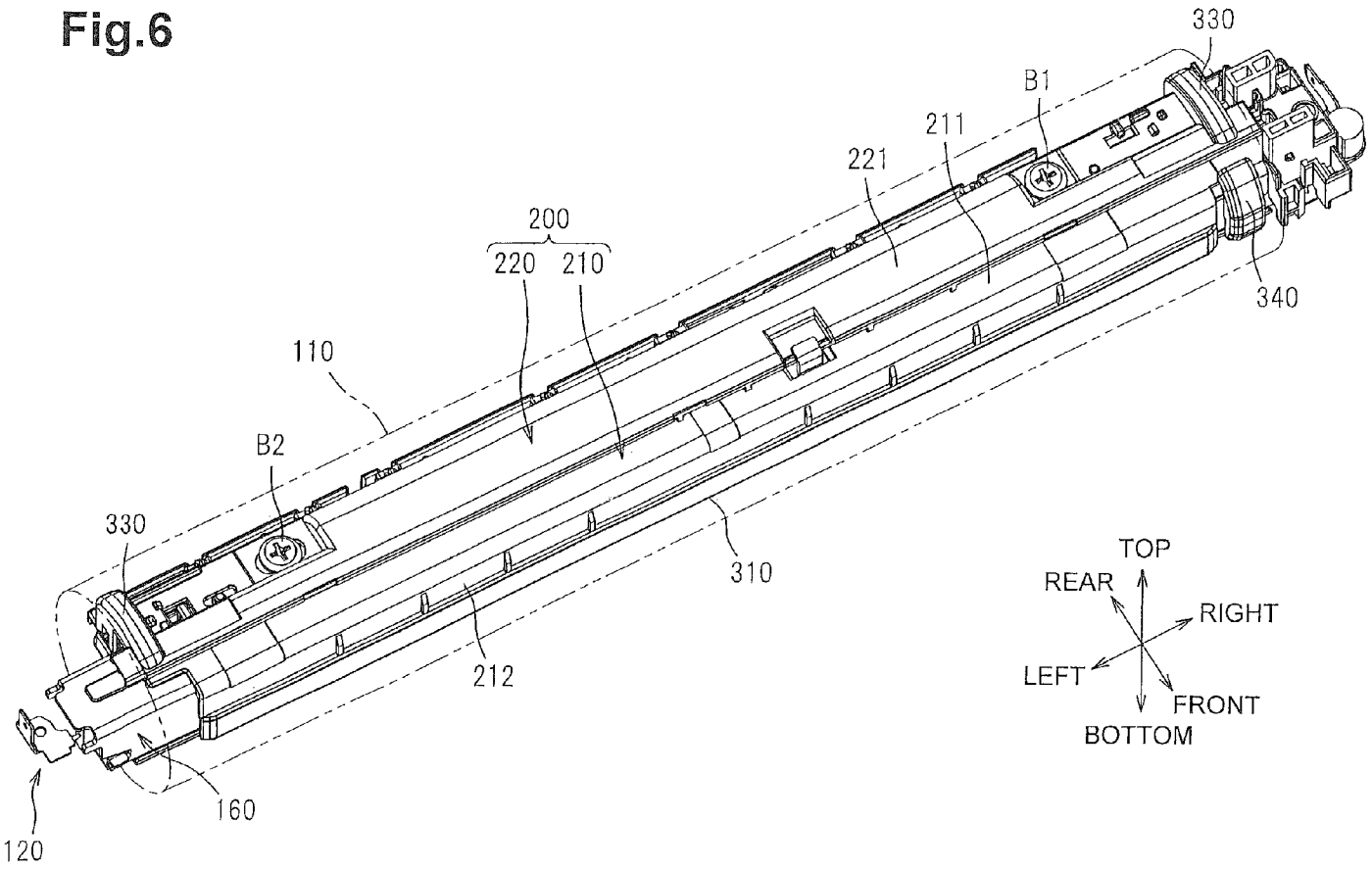
FIG. 6 is a perspective view showing the cover member in view from the front side.

Referring to FIG. 6, the nip upstream guide 310 is continuously provided in a substantially entire range in the axial direction (the left-right direction) of the fusing belt 110.

With such a nip upstream guide 310, the fusing belt 110 can be properly guided to the position between the nip plate 130 and the pressure roller 140.

The nip upstream guide 310 is separated from the upstream end portion 130F of the nip plate 130, and, hence, the entire range in the left-right direction of the nip upstream guide 310 is not in contact with the nip plate 130. Accordingly, the nip upstream guide 310 does not reduce the heat of the nip plate 130. Thermal fixing performance can be improved. Further, according to aspects of the disclosure, the nip plate 130 and the guide member are at least partially separated along a predetermined range within the length of a contact surface of the nip plate 130 in the sheet conveying direction.

Also, the nip upstream guide 310 is not in contact with the reflection member 150. Accordingly, the nip upstream guide 310 does not reduce the heat of the reflection member 150 that receives the radiant heat.

Referring back to FIG. 4, the nip downstream guide 320 guides the fusing belt 110, which comes out from the position between the nip plate 130 and the pressure roller 140. The nip downstream guide 320 may be formed at a rear end portion (i.e., the intermediate portion) of the extension wall 214 of the first cover member 210. To be more specific, the nip downstream guide 320 may be arranged immediately downstream of a downstream end portion 130R of the nip plate 130 (at the other side in the conveying direction of the sheet S) in the rotation direction of the fusing belt 110. The nip downstream guide 320 may have a curved surface protruding toward the inner peripheral surface of the fusing belt 110. In other words, the nip downstream guide 320 may have a guide surface 321 that is a curved surface and guides the inner peripheral surface of the fusing belt 110.

In this embodiment, the nip downstream guide 320 is discontinuously provided in the right-left direction as shown in FIGS. 3 and 5. Alternatively, the nip downstream guide 320 may be continuously provided in a substantially entire range in the axial direction of the fusing belt 110 like the nip upstream guide 310.

With such a nip downstream guide 320, the fusing belt 110, which comes out from the position between the nip plate 130 and the pressure roller 140, can stably move.

In the above description, the wording "immediately upstream" represents that another guide for guiding the rotation of the fusing belt 110 is not provided between the nip upstream guide 310 and the nip plate 130 in the rotation direction of the fusing belt 110. Also, the wording "immediately downstream" represents that another guide is not provided between the nip plate 130 and the nip downstream guide 320 in the rotation direction.

The nip downstream guide 320 is separated from the downstream end portion 130R of the nip plate 130, and, hence, the entire range in the right-left direction of the nip downstream guide 320 is not in contact with the nip plate 130. Accordingly, the nip downstream guide 320 does not reduce the heat of the nip plate 130. Thermal fixing performance can be improved.

Also, the nip downstream guide 320 is not in contact with the reflection member 150. Accordingly, the nip downstream guide 320 does not reduce the heat of the reflection member 150.

Figure 7:
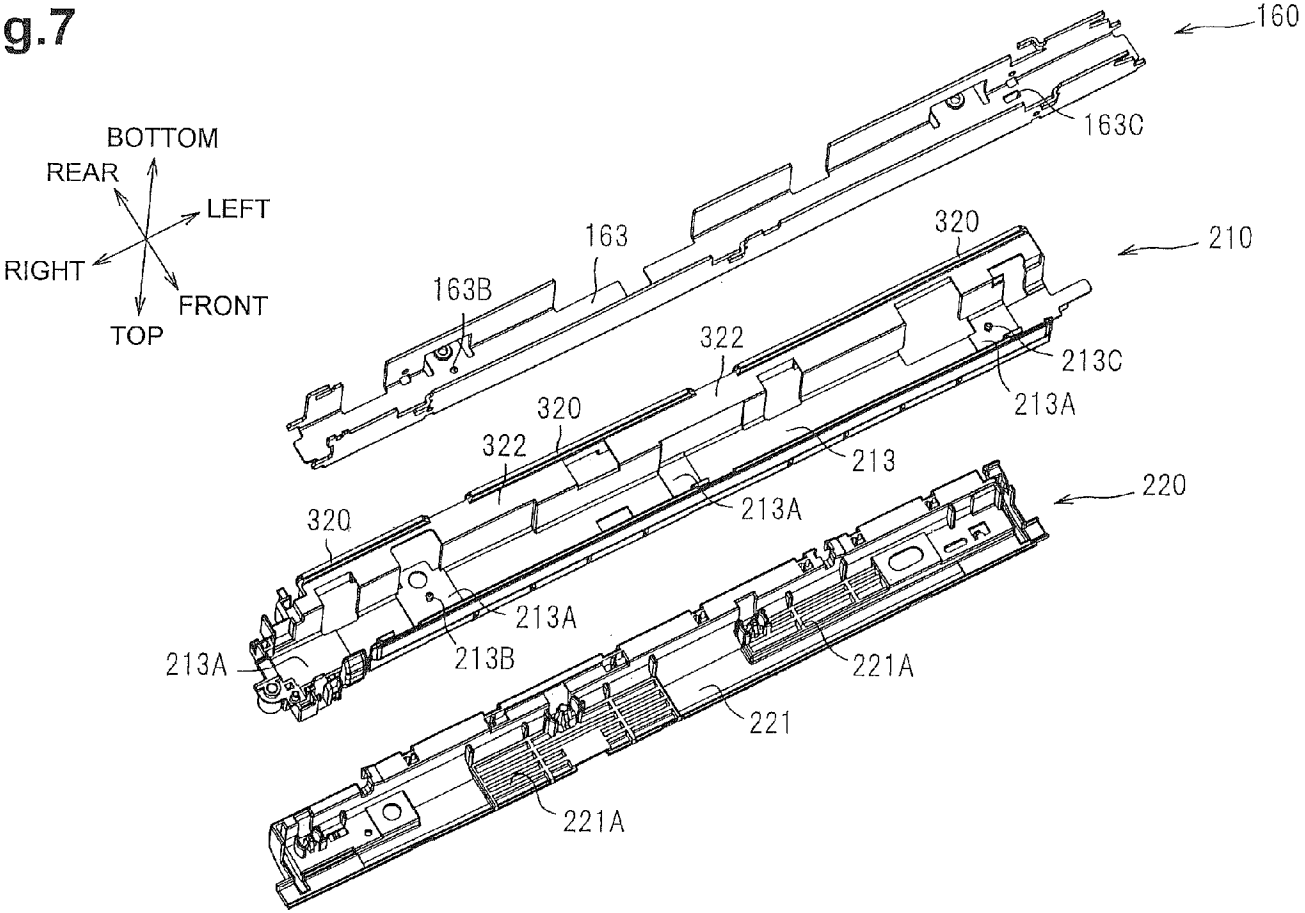
FIG. 7 is a perspective view showing the stay, the first cover member, and the second cover member in view from the lower side.
Figure 8:
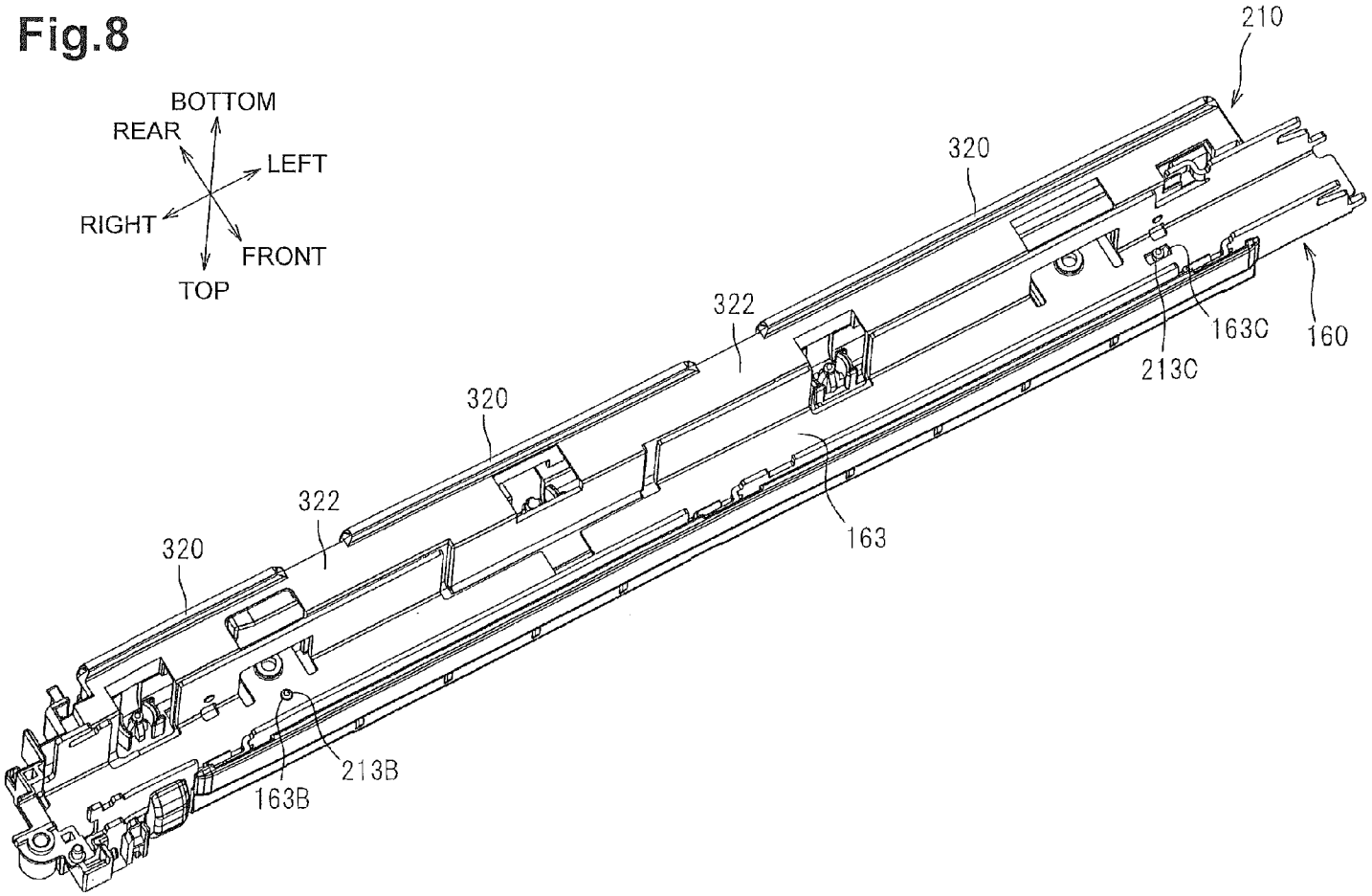
FIG. 8 is a perspective view showing a state in which the first cover member and the second cover member are assembled with the stay in view from the lower side.
Figure 9:
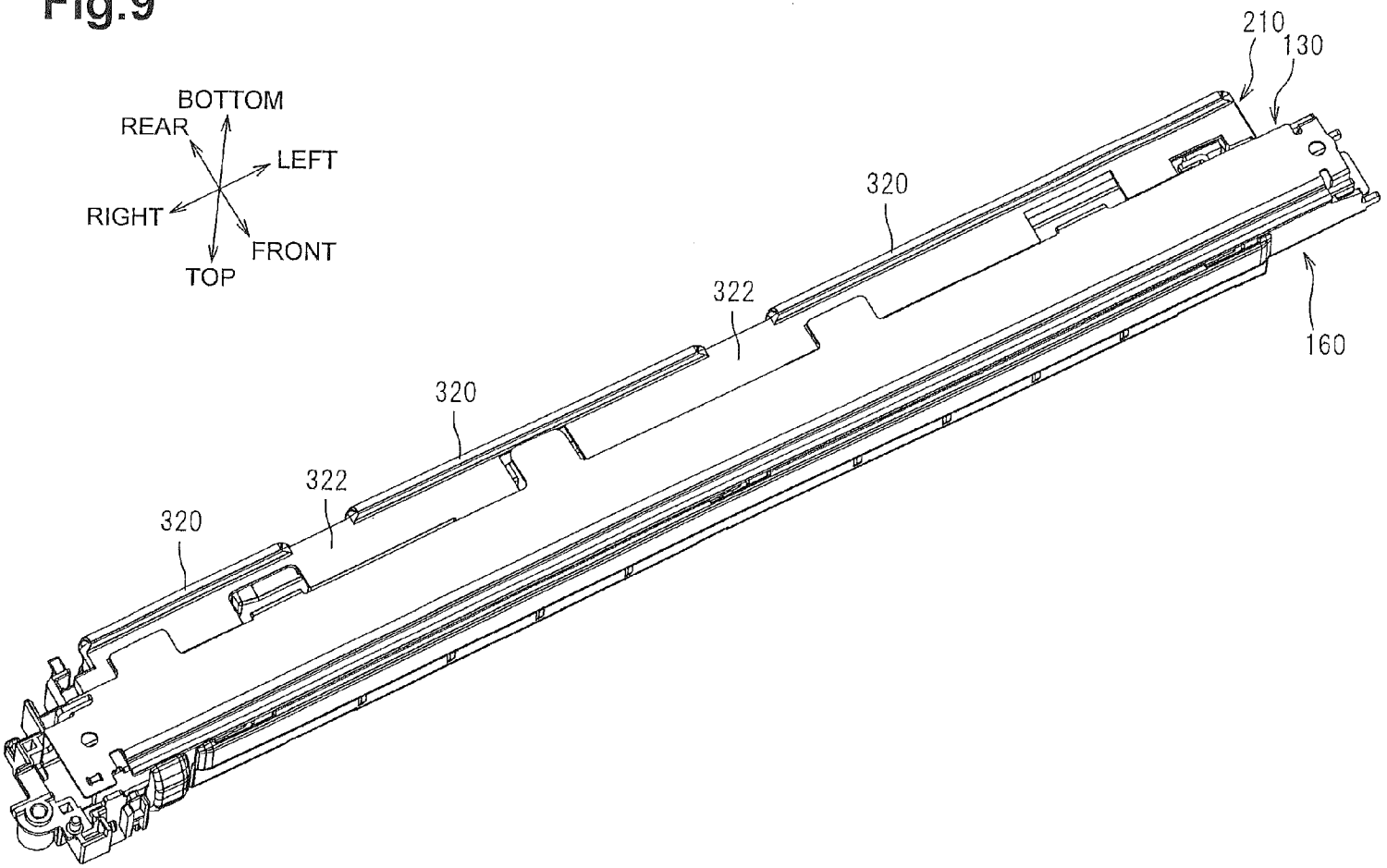
FIG. 9 is a perspective view showing a state in which the nip plate is assembled with the structure in FIG. 8, in view from the lower side.
Figure 10:
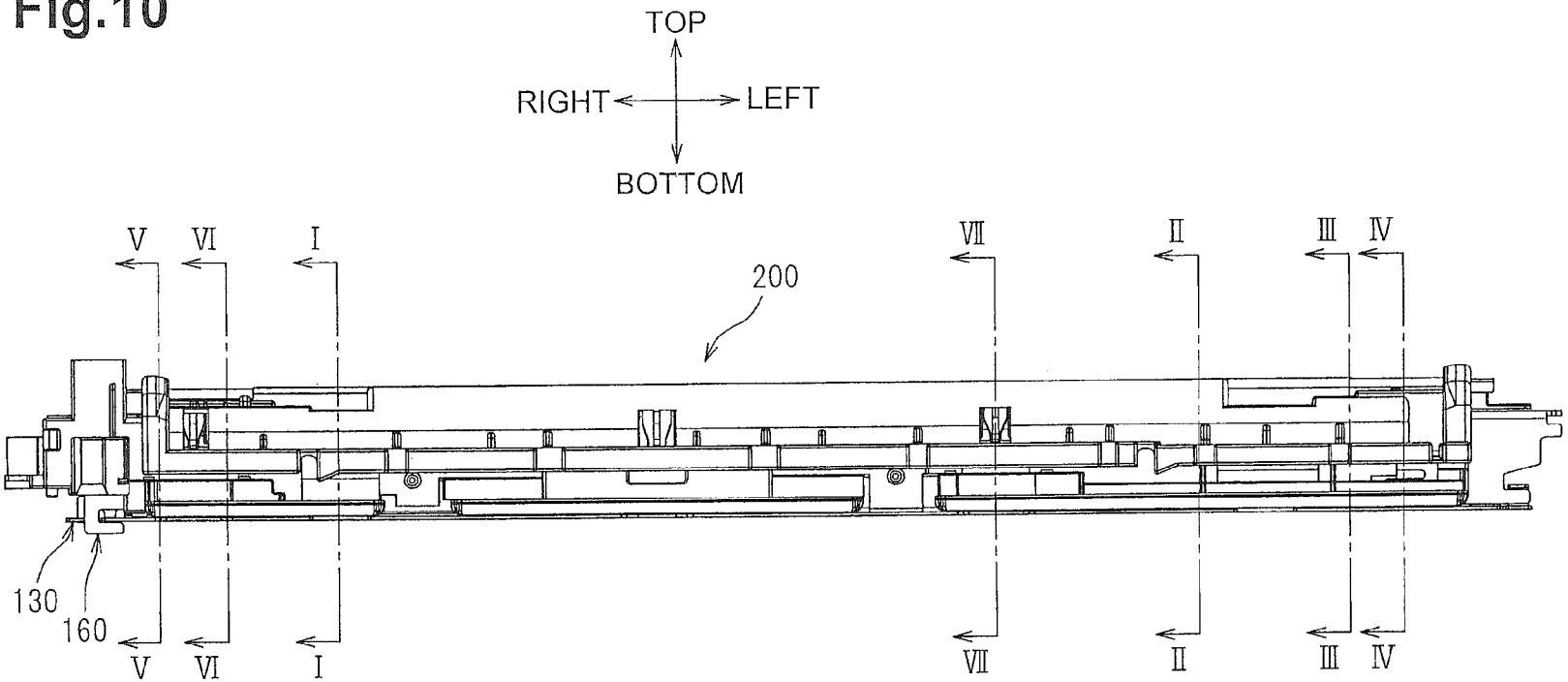
FIG. 10 is a rear view showing the structure in FIG. 9 from the rear side.

A step portion 322 may be formed at a portion near the nip plate 130 with respect to the guide surface 321 of the nip downstream guide 320. The step portion 322 is depressed upward (toward the halogen lamp 120 in a direction in which the nip plate 130 faces the pressure roller 140) with respect to the guide surface 321. For example, the step portion 322 is positioned inwardly towards the halogen lamp 120 relative to the guide surface 321, and which is positioned further from the nip plate 130 than the guide surface 321, in a direction in which the nip plate 130 faces the pressure roller 140, wherein the step portion 322 extends in a width direction of the recording sheet upon which the developer image fixed. Referring to FIGS. 7 to 9 illustrating the respective members in view from the lower side, the step portion 322 is formed substantially entirely in the right-left direction (entirely in the width direction) of the first cover member 210.

Accordingly, a portion of the nip downstream guide 320 located near the nip plate 130 with respect to the guide surface 321 can be reliably separated from the fusing belt 110. The fusing belt 110 can be smoothly rotated.

Referring to FIG. 4, the upper guide 330 guides an upper portion of the fusing belt 110. The upper guide 330 is formed at the upper wall 221 (i.e., the intermediate portion) of the second cover member 220 arranged at the upper side opposite to the nip plate 130 with respect to the halogen lamp 120. In other words, the upper guide 330 is located at the upper side with respect to the extension portions 132 and 133 of the nip plate 130 (at the side of the halogen lamp 120 in the direction in which the nip plate 130 faces the pressure roller 140). The upper guide 330 guides the inner peripheral surface of the fusing belt 110. Accordingly, the upper guide 330 can prevent the fusing belt 110 from largely bending from the nip downstream guide 320. The fusing belt 110 can be prevented from being deteriorated.

To be more specific, referring to FIG. 6, the upper guide 330 is provided at each of both ends of the upper wall 221 in the axial direction of the fusing belt 110 and protrude upward. The upper guide 330 has a curved surface protruding toward the inner peripheral surface of the fusing belt 110 in view in the right-left direction.

Referring to FIG. 4, the front guide 340 guides a front portion of the fusing belt 110. The front guide 340 is formed at the front wall 212 of the first cover member 210. To be more specific, the front guide 340 is provided only at the right end of the front wall 212 and protrudes forward. The front guide 340 has a curved surface protruding toward the inner peripheral surface of the fusing belt 110 in view in the right-left direction.

In this embodiment, the front guide 340 is arranged at the lower side (the side of the halogen lamp 120) with respect to a plane PL tangent to a downstream end portion of the fusing belt 110 in the rotation direction from among a plane in which the guide surface of the upper guide 330 is tangent to the inner peripheral surface of the fusing belt 110.

While a joint is made between the upper guide 330 provided at the second cover member 220 and the front guide 340 provided at the first cover member 210, since the front guide 340 is provided as described above, the fusing belt 110 can be smoothly guided from the upper guide 330 to the front guide 340.

With the above-described upper guide 330 and front guide 340, the fusing belt 110 can stably move in an upper area and a front area of the cover member 200. Also, in this embodiment, since the upper guide 330 is provided only at each of both left and right ends, and the front guide 340 is provided only at the right end, sliding resistance between the inner peripheral surface of the fusing belt 110 and the upper guide 330 or the front guide 340 can be decreased. Accordingly, the fusing belt 110 can be properly rotated.

Referring to FIG. 7, four spacers 213A are formed at the lower surface of the upper wall 213 of the first cover member 210. In other words, each spacer 213A is arranged between the stay 160 and the first cover member 210 (the upper wall 213). Hence, a gap is provided between the stay 160 and the upper wall 213 of the first cover member 210.

Figure 11A:
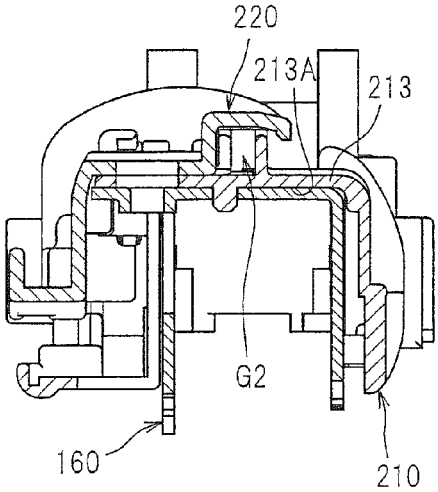
FIG. 11A is a cross-sectional view taken along line I-I in FIG. 10.
Figure 11B:
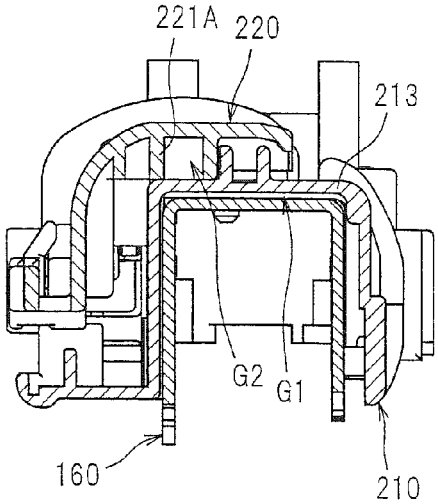
FIG. 11B is a cross-sectional view taken along line II-II in FIG. 10.
Figure 11C:
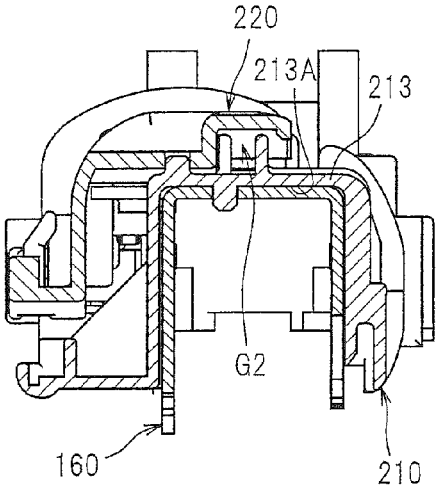
FIG. 11C is a cross-sectional view taken along line III-III in FIG. 10.
Figure 11D:
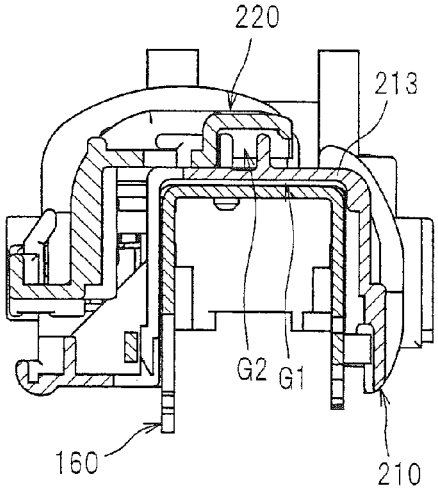
FIG. 11D is a cross-sectional view taken along line IV-IV in FIG. 10.
Figure 12A:
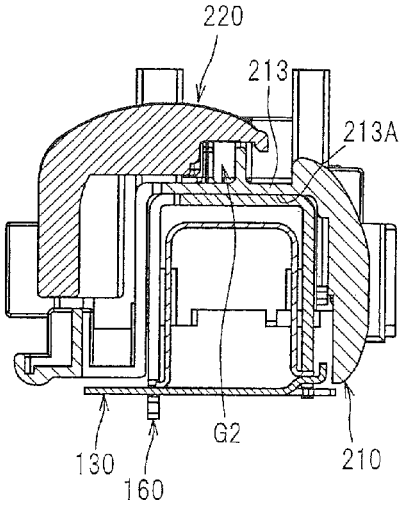
FIG. 12A is a cross-sectional view taken along line V-V in FIG. 10.
Figure 12B:
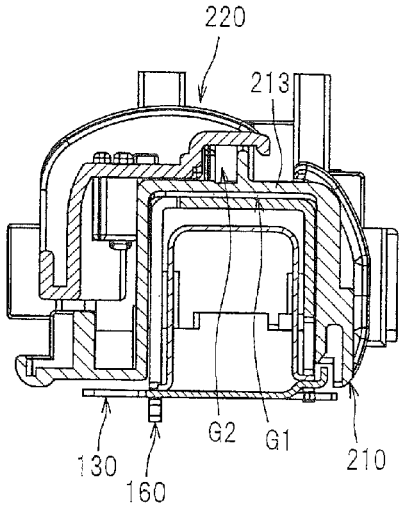
FIG. 12B is a cross-sectional view taken along line VI-VI in FIG. 10.
Figure 12C:
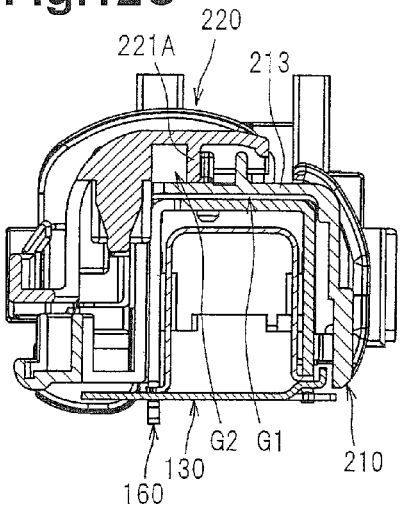
FIG. 12C is a cross-sectional view taken along line VII-VII in FIG. 10.

To be more specific, referring to, FIGS.11A to 11D, and FIGS.12A to 12C showing cross sections crossing the right-left direction of a structure including the cover member 200 and the stay 160, the spacer 213A supports the first cover member 210 in an area provided with the spacer 213A (for example, see FIG. 11A). In contrast, in an area not provided with the spacer 213A (for example, see FIG. 11B), a gap G1 is provided between the upper wall 213 of the first cover member 210 and the stay 160. Accordingly, the gap G1 serves as a thermal barrier. The heat is prevented from being radiated from the stay 160 to the outside, and the nip plate 130 can be efficiently heated. It is to be noted that the nip plate 130 is not illustrated in FIGS. 11A to 11D.

Referring to FIG. 7, each spacer 213A is formed into a step shape protruding downward from the lower surface of the upper wall 213. The spacers 213A are arranged at intervals in the right-left direction (the width direction of the sheet S). Accordingly, the first cover member 210 can be prevented from rattling relative to the stay 160.

The spacers 213A are integrally formed with the first cover member 210 made of resin. Accordingly, the number of parts can be decreased as compared with a configuration in which a spacer member and the first cover member 210 are formed of different parts.

Also, in this embodiment, since the first cover member 210 is made of resin, thermal insulation performance of the first cover member 210 is improved as compared with that the first cover member 210 is made of metal. Accordingly, a phenomenon, in which the heat in the space between the first cover member 210 and the stay 160 is radiated to the outside of the first cover member 210 and the temperature in the space is decreased, can be prevented from occurring. As the result, the heat can be further prevented from being radiated to the space from the stay 160.

Also, a columnar positioning protrusion 213B is formed at the spacer 213A near the right end of the first cover member 210 (specifically, the second one from the right end), and a columnar positioning protrusion 213C is formed at the spacer 213A near the left end of the first cover member 210 (specifically, the first one from the left end). The positioning protrusions 213B and 213C protrude downward (toward the stay 160) from substantially center portions of the lower surfaces of the spacers 213A.

Also, positioning holes 163B and 163C are formed at the upper wall 163 of the stay 160. The positioning protrusions 213B and 213C respectively engage with the positioning holes 163B and 163C. More specifically, the right positioning hole 163B is a circular hole. When the right positioning protrusion 213B is fitted to the positioning hole 163B, the first cover member 210 is positioned in the front-rear and left-right directions with respect to the stay 160.

The left positioning hole 163C is a long hole extending in the left-right direction. When the left positioning protrusion 213C engages with the positioning hole 163C, the first cover member 210 is positioned in the front-rear direction with respect to the stay 160 and thermal expansion in the left-right direction of the first cover member 210 is accommodated.

Since the positioning protrusions 213B and 213C are formed at the spacers 213A that are depressed by a step with respect to the lower surface of the upper wall 213, the height of the positioning protrusions 213B and 213C can be decreased by the depressed amount of the spacers 213A as compared with a structure in which the positioning protrusions 213B and 213C are formed on the lower surface of the upper wall 213. The rigidity of the positioning protrusions 213B and 213C can be increased.

Also, ribs 221A are formed at the lower surface of the upper wall 221 of the second cover member 220. The ribs 221A extend in the front-rear and right-left directions in a lattice-like manner. The ribs 221A are formed at a position shifted to the left and a position shifted to the right from a center portion of the upper wall 221 of the second cover member 220 and are arranged at intervals.

The ribs 221A are arranged between the upper wall 221 of the second cover member 220 and the upper wall 213 of the first cover member 210. Hence, the ribs 221A support the upper wall 221 of the second cover member 220 in a manner separated from the upper wall 213 of the first cover member 210. Accordingly, a gap G2 is provided between the upper wall 221 of the second cover member 220 and the upper wall 213 of the first cover member 210 (see FIGS. 10, 11A to 11D, and 12A to 12C).

Accordingly, the air layers for thermal insulation include the two layers (the gaps G1 and G2). The heat is prevented from being radiated from the stay 160 to the outside, and the nip plate 130 can be further efficiently heated.

Next, assembly of the stay 160, the thermostat 170, the thermistors 180, the coil springs 191 and 192, and the cover member 200 will be described.

In the state shown in FIG. 3, the first cover member 210 is assembled with the stay 160 such that the first cover member 210 covers the stay 160. At this time, referring to FIGS. 7 and 8, the positioning protrusions 213B and 213C of the first cover member 210 are inserted into the positioning holes 163B and 163C of the stay 160. Thus, the first cover member 210 is positioned with respect to the stay 160.

Then, referring to FIG. 3, the thermostat 170 may be arranged at the first positioning portion 231 of the first cover member 210, and the thermistors 180 may be arranged at the second positioning portions 232 of the first cover member 210. The coil spring 191 is attached to the first support portion 241 of the second cover member 220, and the coil springs 192 are attached to the second support portions 242. Then, the second cover member 220 is assembled with the first cover member 210 assembled with the stay 160 such that the second cover member 220 is overlaid on the first cover member 210.

Figure 13A:
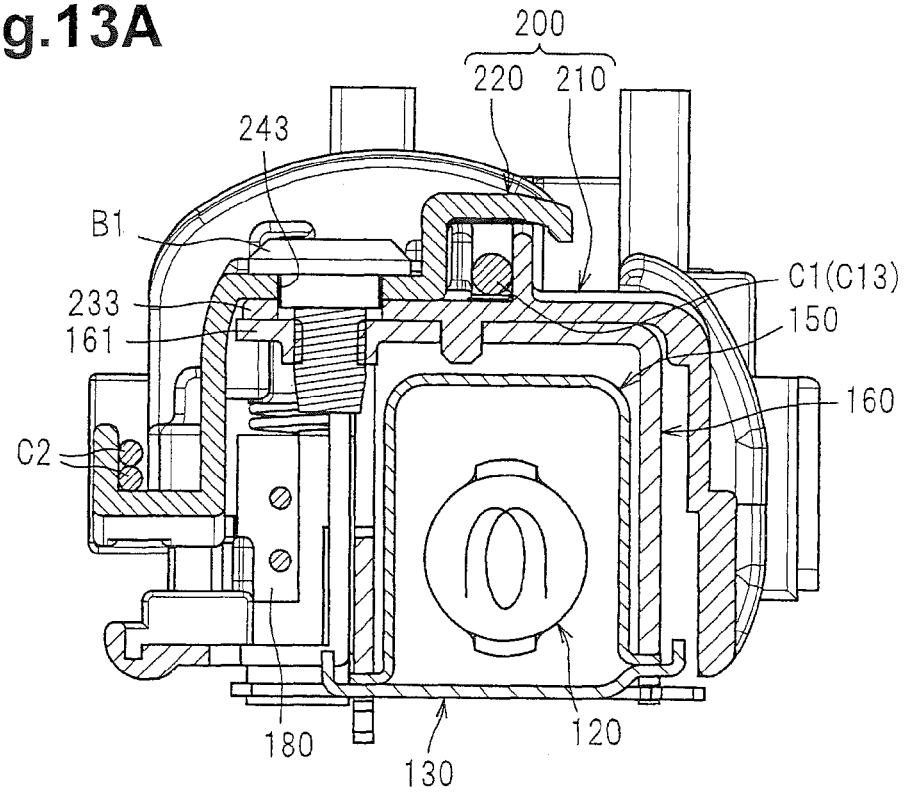
FIG. 13A is a cross-sectional view of an area near a right fixing portion.

Then, referring to FIG. 13A, a screw B1 is inserted through the circular hole 243 of the second cover member 220 and the circular through hole of the first cover member 210 (the fixing portion 233) and is screwed into the screw hole of the right fixing portion 161 of the stay 160. Accordingly, the first cover member 210 and the second cover member 220, i.e., the cover member 200 is fixed to the stay 160 such that the right portion (one side in the axial direction) of the cover member 200 is positioned in the right-left direction with respect to the stay 160.

Figure 13B:
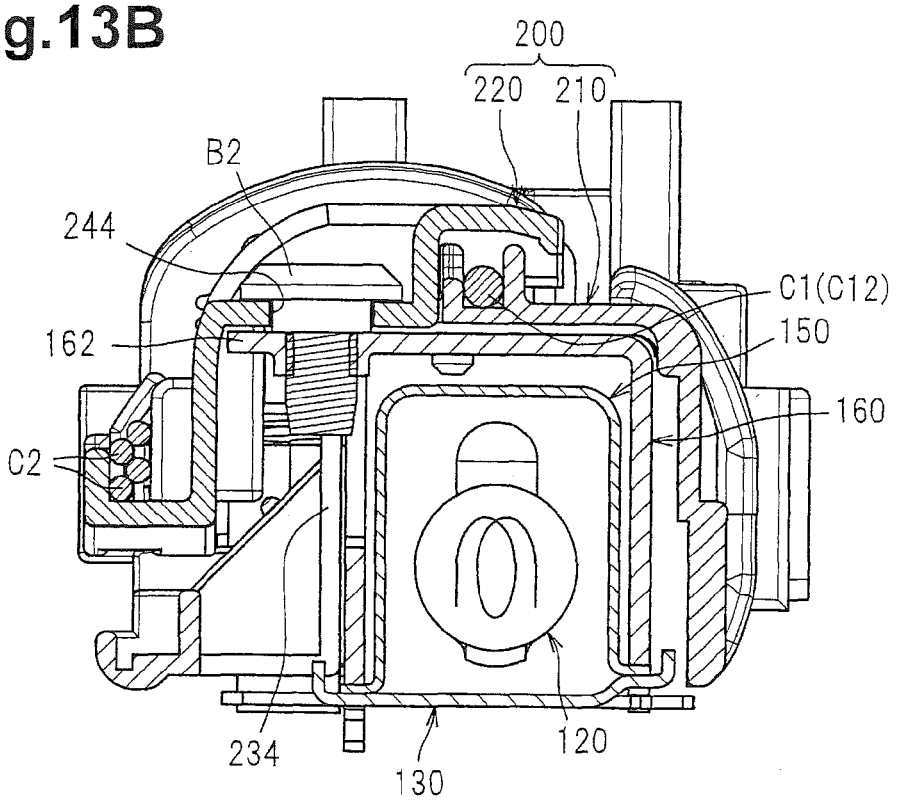
FIG. 13B is a cross-sectional view of an area near a left fixing portion.

Also, referring to FIG. 13B, a screw B2 is inserted into the long hole 244 of the second cover member 220 and the notch 234 of the first cover member 210, and is screwed into the screw hole of the left fixing portion 162 of the stay 160. Since the notch 234 has the larger width in the right-left direction than the length in the right-left direction of the left fixing portion 162 and the long hole 244 is the through hole elongated in the right-left direction, the left portion (the other side in the axial direction) of the cover member 200 is fixed to the stay 160 with a play in the right-left direction with respect to the screw B2 for fixing the cover member 200 to the stay 160.

Thus, the stay 160, the thermostat 170, the thermistors 180, the coil springs 191 and 192, and the cover member 200 are assembled with each other.

In this embodiment, as described above, (1) the first cover member 210, (2) the thermostat 170 and the thermistors 180, and (3) the second cover member 220 that supports the coil springs 191 and 192, are assembled to the stay 160 in order from (1) to (3). Accordingly, assembly efficiency can be improved as compared with a configuration in which the thermostat 170 and the coil spring 191 are assembled with a single cover member.

Also, since the cover member 200 is fixed to the stay 160 such that the right portion of the cover member 200 is positioned and the left portion of the cover member 200 has a play in the right-left direction with respect to the screw B2, even if the stay 160 and the cover member 200 linearly expand when the heat is transmitted thereto, the play can accommodate the expansion. Accordingly, deformation of the stay 160 and the cover member 200 can be restricted.

The embodiment of the present invention has been described above; however, the present invention is not limited to the above-described embodiment. The specific configuration may be appropriately modified within the scope of the present invention.

In the above-described embodiment, the guide member (e.g., the nip upstream guide 310 and the nip downstream guide 320) is integrally formed with the cover member 200. However, the present invention is not limited thereto. The guide member may be a member separated from the cover member. However, if the cover member and the guide member are integrally formed with each other, the number of parts can be decreased. Alternatively, the cover member may be omitted, and only the guide member may be provided at the fixing device.

In the above-described embodiment, the guide surfaces 311 and 321 are provided at both sides of the nip plate 130 in the sheet conveying direction. However, the present invention is not limited thereto. The guide surface may be provided only at one of both sides. However, if the guide surfaces are provided at both sides, the cylindrical member can be prevented from being damaged by the edges at both sides of the nip member in the sheet conveying direction.

In the above-described embodiment, the entire ranges in the left-right direction of the respective guide members (the nip upstream guide 310 and the nip downstream guide 320) are not in contact with the nip plate 130. However, the present invention is not limited thereto. The guide members may include at least a portion that is not in contact with at least a portion in an image formation range W (see FIG. 3) of the nip member. The image formation range W represents a maximum width of an image (a length in the sheet width direction) that can be printed on a maximum-size sheet available for the image forming apparatus.

That is, for example, the guide member may be partly in contact with the nip member while the guide member is substantially not in contact with the portion in the image formation range W of the nip member. With this configuration, the guide member has the portion that is not in contact with the portion in the image formation range W of the nip member. Hence, the guide member does not reduce the heat of the portion in the image formation range W of the nip member, and the nip member can be efficiently heated. Similarly, the guide member may include a portion that is not in contact with a portion in an image formation range of the reflection member.

In the above-described embodiment, the step portion 322 extends substantially entirely in the right-left direction of the first cover member 210. However, the present invention is not limited thereto. The step portion may be formed at least at part in the width direction of a recording sheet of a portion of the first cover member near the nip member with respect to the guide surface. Even in this case, the at least part (part with the step portion) of the portion near the nip member with respect to the guide surface can be reliably separated from the cylindrical member. The sliding resistance of this part with respect to the cylindrical member can be decreased, and the cylindrical member can be smoothly rotated.

In the above-described embodiment, the nip member employs the plate-like nip plate 130. However, the present invention is not limited thereto. The nip member may be a thick member that does not have a plate-like shape.

In the above-described embodiment, the upper guide 330 is provided at both ends in the axial direction of the fusing belt 110. However, the present invention is not limited thereto. For example, the guide portion of the extension portion may be discontinuously provided in the axial direction of the cylindrical member, or may be provided in the entire range in the axial direction.

In the above-described embodiment, the cover member 200 is fixed to the stay 160 such that the right portion of the cover member 200 is positioned and the left portion of the cover member 200 has a play in the right-left direction with respect to the screw B2 (a fastening tool). However, the present invention is not limited thereto. For example, the cover member may be fixed to the stay such that the center in the axial direction of the cylindrical member is positioned and both ends in the axial direction of the cylindrical member have plays in the left-right direction with respect to the fastening tool.

In the above-described embodiment, the first cover member 210 and the second cover member 220 are fixed to the stay 160 by the common screws B1 and B2. However, the present invention is not limited thereto. The first cover member and the second cover member may be fixed to the stay by different screws.

In the above-described embodiment, the first cover member 210 and the second cover member 220 are assembled with each other such that first and second cover members are partly overlaid on each other. However, the present invention is not limited thereto. For example, one of frames may entirely cover the other of the frames when the frames are overlaid on each other.

In the above-described embodiment, the cover member is formed of two frames (parts). However, the present invention is not limited thereto. For example, the cover member may be formed of a single part, or three or more parts.

In the above-described embodiment, the pressure roller 140 exemplarily serves as the pressure member. However, the present invention is not limited thereto. For example, a belt-like pressure member may be used.

In the above-described embodiment, the halogen lamp 120 (a halogen heater) serves as the heater. However, the present invention is not limited thereto. For example, the heater may be a carbon heater or a heater using induction heating (IH).

In the above-described embodiment, the fusing belt 110 (the cylindrical member) is made of metal. However, the present invention is not limited thereto. For example, the fusing belt 110 may be formed of resin such as polyimide resin, or an elastic material such as rubber. Also, the cylindrical member may have a multilayer structure. To be more specific, for example, a resin layer for decreasing the sliding resistance may be provided on the surface of the metal belt, or an elastic layer such as a rubber layer may be provided on the surface of the metal belt.

In the above-described embodiment, both the reflection member 150 and the stay 160 are provided. However, the present invention is not limited thereto. Only the stay may be provided. If only the stay is provided (without the reflection member), the stay may have a reflection surface that reflects radiant heat from the heater to the nip plate so as to face the heater (i.e., the stay and the reflection member may be integrally formed).

In the above-described embodiment, the sheet S, such as normal paper or a post card, exemplarily serves as the recording sheet. However, the present invention is not limited thereto. For example, an OHP sheet (a transparency film used for an overhead projector) may be used.

In the above-described embodiment, the laser printer 1 that forms a monochrome image exemplarily serves as the image forming apparatus including the fixing device according to the present invention. However, it is not limited thereto. For example, a printer that forms a color image may be used. Also, the image forming apparatus is not limited to the printer, and may be, for example, a copier or a multi-function apparatus including a document reading device such as a flatbed scanner.

What is claimed is:

1. A fixing device configured to fix a developer image onto a recording sheet, the fixing device comprising:

a flexible cylindrical member which has an inner peripheral surface and is configured to rotate about an axis;

a heater arranged inside the flexible cylindrical member and extending in an axial direction of the flexible cylindrical member;

a nip member, which includes:

a contact surface which is configured to contact the flexible cylindrical member, and includes a predetermined length in a sheet conveying direction; and an axial length which includes a predetermined range;

a pressure member, the pressure member and the nip member being configured to pinch the flexible cylindrical member therebetween; and a guide member arranged at least at one side of the nip member in the sheet conveying direction and including a guide surface that is configured to guide the inner peripheral surface of the flexible cylindrical member, wherein the inner peripheral surface of the flexible cylindrical member is configured to slide on the nip member, and wherein the guide member and the nip member are at least partially separated along the predetermined range of the nip member within the predetermined length of the contact surface in the sheet conveying direction.

2. The fixing device according to claim 1, wherein the guide member is not in contact with the nip member.

3. The fixing device according to claim 1, further comprising:

a step portion positioned inwardly towards the heater relative to the guide surface of the guide member, and which is positioned further from the nip member than the guide surface, in a direction in which the nip member faces the pressure member, wherein the step portion extends in the axial direction.

4. The fixing device according to claim 3, wherein the step portion extends in the axial direction along a majority of an axial length of the guide member.

5. The fixing device according to claim 1, wherein the guide surface includes surfaces at both sides of the nip member in the sheet conveying direction.

6. The fixing device according to claim 1, further comprising:

a stay configured to support the nip member and, at least in part, surround the heater; and a cover member configured to cover the stay and positioned between the flexible cylindrical member and the heater, wherein the guide member is integrally formed with the cover member.

7. The fixing device according to claim 1, further comprising:

a reflection member configured to reflect radiant heat from the heater to the nip member, wherein the reflection member and the nip member are arranged such that, together, the reflection member and the nip member surround the heater, wherein the reflection member includes a predetermined range along an axial length of the reflection member, and wherein the guide member and the reflection member are at least partially separated along the predetermined range of the reflection member.

8. The fixing device according to claim 7, wherein the guide member is not in contact with the reflection member.

9. A fixing device for fixing a developer image onto a recording sheet, the fixing device comprising:

a belt having a first surface and a second surface that is an opposite surface of the first surface;

a heater which is arranged inside the belt and has a longitudinal length;

a nip member, which includes:

a contact surface which is configured to contact the belt, and includes a predetermined length in a sheet conveying direction; and a longitudinal length which extends in a direction parallel to the longitudinal length of the heater and includes a predetermined range; and a guide member including a guide surface arranged at least at one side of the nip member in the sheet conveying direction of the recording sheet that is configured to guide the first surface of the belt, wherein the guide member is not in contact with the nip member within an image formation range of the nip member.

10. The fixing device according to claim 9, wherein the guide member is arranged immediately upstream of the nip member in the sheet conveying direction.

11. The fixing device according to claim 10, wherein the guide surface is arranged immediately upstream of the nip member in the sheet conveying direction.

12. The fixing device according to claim 9, wherein the guide member is arranged immediately downstream of the nip member in the sheet conveying direction.

13. The fixing device according to claim 12, wherein the guide surface is arranged immediately downstream of the nip member in the sheet conveying direction.

14. The fixing device according to claim 9, wherein the nip member is a metal plate.

15. The fixing device according to claim 9, wherein a majority of the guide member is separated from the nip member.

16. The fixing device according to claim 9, wherein the guide member extends continuously along a longitudinal direction of the nip member.

17. The fixing device according to claim 9, wherein the guide member extends discontinuously along a longitudinal direction of the nip member.

18. The fixing device according to claim 9, wherein the guide member is not in direct contact with the nip member within the predetermined range.

* * * * *